US007570222B2

(12) United States Patent
King

(10) Patent No.: US 7,570,222 B2
(45) **Date of Patent: *Aug. 4, 2009**

(54) SEMI-AUTOMATIC SATELLITE LOCATOR SYSTEM

(75) Inventor: Lael D. King, Minneapolis, MN (US)

(73) Assignee: King Controls, Bloomington, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/986,832

(22) Filed: Nov. 27, 2007

(65) Prior Publication Data

US 2008/0136722 A1 Jun. 12, 2008

Related U.S. Application Data

(63) Continuation of application No. 11/215,820, filed on Aug. 29, 2005, now Pat. No. 7,301,505, which is a continuation of application No. 10/794,396, filed on Mar. 5, 2004, now Pat. No. 6,937,199.

(60) Provisional application No. 60/452,224, filed on Mar. 5, 2003.

(51) Int. Cl.
*H01Q 3/00* (2006.01)

(52) U.S. Cl. ..... 343/765; 343/757

(58) Field of Classification Search ..... 343/757, 343/765, 766; 342/359

See application file for complete search history.

(56) References Cited

U.S. PATENT DOCUMENTS

| | | | |
|---|---|---|---|
| 4,654,670 | A | 3/1987 | Fleming |
| 4,804,972 | A | 2/1989 | Schudel |
| 5,019,833 | A | 5/1991 | Nonaka |
| 5,274,382 | A | 12/1993 | Wills et al. |
| 5,296,862 | A | 3/1994 | Rodeffer et al. |
| 5,309,162 | A | 5/1994 | Uematsu et al. |
| 5,398,035 | A | 3/1995 | Densmore et al. |
| 5,448,254 | A | 9/1995 | Schneeman et al. |
| 5,471,219 | A | 11/1995 | Rodeffer et al. |
| 5,528,250 | A | 6/1996 | Sherwood et al. |
| 5,585,804 | A | 12/1996 | Rodeffer |
| 5,945,945 | A | 8/1999 | Wagner et al. |
| 5,983,071 | A | 11/1999 | Gagnon et al. |
| 6,029,044 | A | 2/2000 | Arsenault et al. |

(Continued)

OTHER PUBLICATIONS

KVH Industries, Inc.'s Amended Answer and Counterclaims from Case No. 05-CV-1027 (JMR/FLN) venued in the United States District Court, District of Minnesota.

(Continued)

*Primary Examiner*—Hoang V Nguyen
(74) *Attorney, Agent, or Firm*—Ulbrich I.P., Ltd.

(57) ABSTRACT

A method for positioning a dielectric dome covered satellite dish adapted to be connected to a satellite receiver, by inputting an elevation command into a control console corresponding to a geographic location of the satellite dish and then depressing a single key on the control console to activate an azimuth drive system on the satellite dish. The operator depresses any key on the console to stop azimuth rotation of the satellite dish upon viewing a satellite signal. The satellite signal is fine tuned by appropriately depressing the right arrow key, a left arrow key, an up arrow key, or a down arrow key to effect pointing of the satellite dish.

9 Claims, 5 Drawing Sheets

U.S. PATENT DOCUMENTS

| | | | |
|---|---|---|---|
| 6,538,612 | B1 | 3/2003 | King |
| 6,693,587 | B1 | 2/2004 | Kuether et al. |
| 6,710,749 | B2 | 3/2004 | King |
| 6,864,846 | B2 | 3/2005 | King |
| 6,937,199 | B2 | 8/2005 | King |
| 7,301,505 | B2 | 11/2007 | King |

OTHER PUBLICATIONS

KVH Industries, Inc.'s Notice Pursuant to 35 U.S.C. § 282.
Datron/Transco Inc. Brochure for Datron DBS-3000 and DBS-4000 Mobile Satellite Systems.
Datron/Transco Inc. Brochure, Product Information sheet for DBS-3000 Mobile Satellite Television System, Dec. 1996.
Datron/Transco Inc. Brochure for DBS-3000 Marine Satellite Television System, Aug. 1996.
Datron/Transco Inc. Video (DVD).
Datron/Transco Inc. Installation Instructions for DBS-3000-300 Mobile Satellite Television System, 1997.
Datron/Transco Inc. User's Guide for DBS-3000 Mobile Satellite Television System, 1999.
Datron/Transco Inc. User's Guide for DBS-3000 Marine Satellite Television System, 1997.
Datron/Transco Inc. Installation Instructions for DBS-4000-100 In-Motion Satellite Television System, 1997.
Datron/Transco Inc. Drawing No. 127826.
Datron/Transco Inc. Installation Instructions for DBS-4000-100 In-Motion Satellite Television System, 1996.
Datron/Transco Inc. Drawing No. 130144.
Cruise TV by Datron, Datron/Transco Inc. Installation Instructions for The DBS-4500 / Land Version In-Motion Satellite Television System, 1999.
Cruise TV by Datron, Datron/Transco Inc. User's Guide for The DBS-4500 / Land Version In-Motion Satellite Television System, 1999.
Datron/Transco Inc. Drawing No. 130126.
Datron/Transco Inc. Brochure for Datron DBS-4500 Satellite Tracking System, May 1999.
Datron/Transco Inc. Brochure for Datron DBS-4000 In-Motion Satellite Television System, Oct. 1998.
Datron/Transco Inc. User's Guide for DBS-30500 Mobile Mobile Satellite Television System, 1999.
Datron/Transco Inc. Installation Instructions for DBS-30500 Mobile Satellite Television System, 1999.
King Controls Brochure for King Dome Automatic Satellite System, 1998.
King Satellite Locator System product information, Mar. 5, 1999.
King Controls Owner's Manual and Installation Instructions for King-Dome Automatic Satellite System.
King Controls Installation Manual for King-Dome Automatic Satellite System #9702.
King Controls Installation Manual for King-Dome In-Motion Satellite System #9752.
KVH Industries, Inc. Owner's Manual for KVH Industries TracVision 45, 1998.
KVH Industries, Inc. Brochure for KVH TracVision 45.
Eutelstat Digital Satellite Equipment Control (DiSEqC) Bus Functional Specification Version 4.2, Feb. 25, 1998.
KVH Industries, Inc. Owner's Manual for KVH Industries TracVision II, 1998.
KVH Industries, Inc. Technical Manual, User's Guide and Installation Guidelines for KVH TracVision II Stabilized Antenna Pedestal System, 1997.
KVH Industries, Inc. Brochure for KVH's TracVision II, Oct. 1998.
KVH Industries, Inc. Brochure for KVH TracVision LM, 1998.
KVH Industries, Inc. Brochure for KVH TracVision LM, 1999.
KVH Industries, Inc. Installation Instructions, User's Guide and Technical Manual for KVH TracVision LM, 1999.
KVH Industries, Inc. User's Manual for KVH Industries TracVision LM, 1999.
KVH Industries, Inc. Technical Manual, User's Guide and Installation Guidelines for KVH TracVision 3, 1999.
KVH Industries, Inc. Technical Manual, User's Guide and Installation Guidelines for KVH Industries' TracVision Cuiser, 1999.
KVH Industries, Inc. Installation Instructions, User's Guide and Technical Manual for KVH Industries' TracVision C3, 2000.
KVH Industries, Inc. Brochure for TracVision G4, 2000.
KVH Industries, Inc. Owner's Manual for KVH TracVision G4, Rev. A, 1999.
KVH Industries, Inc. Owner's Manual for KVH TracVision G4, Rev, B, 1999.
KVH Industries, Inc. Owner's Manual for KVH TracVision 4, Rev. A, 2000.
KVH Industries, Inc. Owner's Manual for KVH TracVision 4, Rev. B, 2000.
KVH Industries, Inc. Installation Instructions, User's Guide and Technical Manual for KVH TracVision L3, Rev. A, 2000.
KVH Industries, Inc. Installation Instructions, User's Guide and Technical Manual for KVH TracVision L3, Rev. B, 2000.
What Satellite TV, Digital Watch, Jan. 1997.
Dr. Frank Baylin, 1998/2000 World Satellite Yearly, 5$^{th}$ Edition.
Digital Satellite TV, 5$^{th}$ Edition.
Bruce R. Elbert, Introduction to Satellite Communication, Artech House.
Anthony T. Easton, The Home Satellite TV Book, How to Put the World in Your Backyard, Wideview/Perigee Book.
Scientific Atlanta Installation and Operation Guide for Model 8862/8864 Antenna Position Controller, 1996.
Scientific Atlanta Technical Manual for Model 8860 Antenna Tracking Controller Operation, 1995.
Sea Tel, Inc. Quick Start Installation and Operation Guide for Sea Tel Model 1898 Shipboard Satellite TV Receive-Only System, Feb. 1999.
Sea Tel, Inc. Installation and Operation Manual for Sea Tel Model 2494 Shipboard Satellite TV Receive-Only System, Nov. 1999.
Sea Tel, Inc. Quick Start Operation for Series 94 DBS Systems.
Sea Tel, Inc. Installation and Operation Manual for Sea Tel Model 2494 Shipboard Satellite TV Receive-Only System, Dec. 1994.
Sea Tel, Inc. Installation and Operation Manual for Sea Tel Model 2094 Shipboard Satellite TV Receive-Only System, May 1996.
KVH Industries, Inc.'s Motion for Summary Judgment.
Jan. 9, 2007 Order of James M. Rosenbaum denying KVH Industries, Inc.'s Motion for Summary Judgment.
Plaintiff King Controls' Concise Statement of Its Case-In-Chief.
KVH Industries, Inc.'s Statement of Its Case-In-Chief.
Electronic Controlled Systems, Inc., d/b/a *King Controls* v. *KVH Industries, Inc.*, KVH Industries, Inc.'s Memorandum Of Law In Support Of Its Renewed Motion For Judgment As A Matter Of Law That Claim 5 Is Invalid Under The Written Description Requirement of 35 U.S.C. §112, 5 pages, Aug. 27, 2007.
Electronic Controlled Systems, Inc., d/b/a *King Controls* v. *KVH Industries, Inc.* Order, 1 page, Sep. 12, 2007.
Electronic Controlled Systems, Inc., d/b/a *King Controls* v. *KVH Industries, Inc.* Amended Judgment In A Civil Case, 1 page, Aug. 16, 2007.
Electronic Controlled Systems, Inc., d/b/a *King Controls* v. *KVH Industries, Inc.*, Verdict, 2 pages, Aug. 10, 2007.

SEMI-AUTOMATIC SATELLITE LOCATOR SYSTEM

The present invention claims priority to U.S. Provisional Application 60/452,224, filed Mar. 5, 2003, and hereby incorporated by reference in its entirety. The present invention is a continuation of and claims priority to prior application Ser. No. 11/215,820, filed Aug. 29, 2005, now U.S. Pat. No. 7,301,505, which is a continuation of prior application Ser. No. 10/794,396, filed Mar. 5, 2004, now U.S. Pat. No. 6,937,199 for: SEMI-AUTOMATIC SATELLITE LOCATOR SYSTEM by: Lael D. King all of which are hereby incorporated by reference in their entirety.

FIELD OF THE INVENTION

The present invention relates generally to satellite antenna systems and in particular to a satellite antenna system for mobile units which includes a semi-automatic locator system.

BACKGROUND OF THE INVENTION

The growth in the number of available media channels and improved reception due to digital broadcasts has driven consumers to look beyond normal television antennas and cable systems. Digital signals broadcast from satellites are capable of providing hundreds of video, audio and data channels to users without the constraint of land line connections. The programming is distributed by a constellation of satellites parked in a geosynchronous orbit at 22,300 miles above the earth. The broadcast from orbit allows users to receive broadcasts in many areas; such as mountainous regions or desolate areas, where earth based transmitters traditionally are unable to reach.

Conventional satellite communication systems utilize microwave receiving antennas or parabolic reflector dishes connected to arms supporting feedhorns and signal converters. Cables couple the converters to receivers which provide converted output signals for televisions or computers. The antennas are typically mounted on supports fixed to the ground or a building. Antenna directional adjustors associated with the supports and antennas are used to direct the antennas toward a selected satellite. The adjustors change the elevation and azimuth angles of the antennas and maintain adjusted position of the antennas. The antenna adjustments depend on the location of the antennas relative to the surface of the earth since the satellites are in a geosynchronous orbit and remain in a fixed position relative to the earth's surface.

While such satellite systems provide a multitude of media options, in order to benefit from the service there continues to be a need to position the antenna correctly towards the appropriate satellite. In a conventional installation, an installer points the antenna with the desired elevation and azimuth to receive the signal from the contracted provider. Because a conventional installation is stationary, further tracking or adjustments are not necessary once the installation is complete.

The positioning of a receiver antenna becomes problematic when the receiver antenna is mounted to a mobile unit. When the satellite communication systems are moved to a new location, the elevation and azimuth angles of the antenna must be adjusted to align the antenna with the selected satellite. Determining satellite location is especially problematic to the user who may be in a new location every night. Such users wish to attach a satellite receiver system to a bus, boat, motor home, trailer, commercial vehicle, van, camper or other mobile unit. For example, many buses and recreational vehicles install satellites receiver systems on the roof of the vehicle. When they park at night they may have to first position the antenna to an operating position and then adjust elevation and azimuth position to locate the desired satellite.

Currently there are a wide variety of satellite antenna systems available. The earliest models were tripod or post type dishes that were mounted on the ground and manually aimed. Advances and increased market usage created a need for roof top mounted systems. The initial versions also used a crank to manually aim an exposed satellite dish at a satellite. The manual component of aiming the dish generally contributed to poor reception. Furthermore, the manual aspect required the user to either run back and forth from the dish to the television to check on signal or recruit a helper to notify the user when the satellite dish was aligned properly. The manual units are likely to have poor reception due to the difficulty in finding a satellite.

While inexpensive, the manually aimed, exposed dish systems are easily damaged by the environment. These antennas are exposed to wind, insects, mud, dirt, dust, snow, ice and ultraviolet radiation. In some installations the exposed dishes are pivoted to a generally horizontal non-functional position when the vehicle is moving to reduce the wind forces on the dish. In addition, environmental conditions such as high wind may shut down operation for an unprotected system due to misaiming the focal point. To avoid the problems outlined above, dome systems were introduced to protect the dish. Covered systems allow the dish to always remain in an upright protected position.

In order to further enhance signal quality, fully automatic tracking system were developed. These systems are expensive due to the complex tracking algorithms and motor control required to automatically recognize position and then conduct a search of the sky. These high costs preclude their use by many consumers. Moreover, the details required to perform an automatic search are often time sensitive. Changes in programming, satellite constellation locations create compatibility issues that require software changes that further increase cost.

Therefore, there is a need then for a low cost environmentally protected satellite receiver system capable of providing television, radio and Internet reception to users who are unable to receive the respective signal through a conventional land line or are viewing from a mobile position that requires locating the satellite signal. The system should be robust enough to survive travel. Furthermore, the locating mechanism should be simple enough for the user to locate the satellite before each use by incorporation of an easily programmable satellite locator system.

SUMMARY OF THE INVENTION

The present invention substantially meets the requirements as stated above. The King Dome™ AutoScan Satellite System is a semi-automatic dome covered, motor driven satellite antenna covered and protected by a dielectric dome. The antenna, when aimed at high-powered DBS satellites owned and operated by Echostar (Dish Network), Hughes Electronics (DirectTV), and Bell ExpressVU, allows for satellite television and Internet reception. Aiming is accomplished by rotating (left or right) the antenna in azimuth and tilting (up or down) the antenna in elevation precisely at a satellite. Antenna movement is preferably accomplished using low cost DC motors and a hand held user console. Each geosynchronous satellite location is given in azimuth and elevation degrees by entering the local zip code into the digital integrated receiver/decoder (IRD) set-top box or from a geographic reference chart. The menu screen preprogrammed with zip code driven azimuth and elevation information includes signal strength information for maximizing the amount of signal by more accurately aiming the antenna. The semi-automatic console has up and down buttons for adjusting elevation, right and left buttons for adjusting azimuth, and a two digit display for elevation, azimuth position and diagnostic messages.

The semi-automatic satellite locator system includes a dome covered dish antenna. The dome protects the dish from the weather as compared to exposed dish systems where wind affects reception. Exposed dish systems typically lose reception because wind gusts move the dish antenna from the satellite location. Moreover, an exposed dish system has a shorter operational life. Moisture, freezing conditions, direct sun all affect the lifespan of the exposed dish as well as any exposed electronics.

A further operational advantage of a dome covered system is that the dome protected dish of the present invention is always ready for use. The dish antenna of the present invention does not have to be stowed while the vehicle is in motion. The dish antenna can remain at the last elevation due to the protection provided by the dome. This allows the end user to relocate a satellite much more quickly during the next search. In fact, if the end user has not traveled more than 250 miles north or south of their last satellite found location, they will need to adjust elevation less than 3 degrees.

While a dome protects the satellite system from the environment, it also reduces signal strength. An additional advantage to the present invention is the unique design of the dome decreases vehicle drag while maximizing signal strength especially in rain. The dome is sized so that the Low Noise Block converter (LnB) is in close proximity to inside dome face through all elevation and rotation permutations. As a result the exterior size of the dome is minimized reducing aerodynamic drag. Further, close placement of the LnB combined with the steep sided dome wall shed precipitations and helps to reduce signal loss.

The present invention includes a remote control console to drive the motors which adjust elevation and azimuth. The remote control console includes a set of directional controls. The remote control console also includes a two-digit display for both elevation and azimuth position feedback. The display shows elevation angle in degrees. The display shows azimuth by a clock reference.

The two-digit numeric display on the remote control console also provides installers, dealers, OEM's and end users the capability to monitor the system diagnostics. Two-digit codes represent specific operations/status modes and potential fault codes. For example, the display will show if power is supplied to the dome, if there is an IRD present in the system, and fault codes for low voltage, failed motors, and other diagnostic messages concerning status of the invention.

A common problem with manual adjustable crank-up systems is that the user rotates or elevates the dish too fast. If the dish is rotated or elevated to quickly, the IRD will not have sufficient time to pick up a signal and provide feedback that notifies the user to stop moving the satellite. Quick rotation by the operator may result in never finding the satellite. The elevation and azimuth motors of the present invention are controlled so as to drive the dish at speeds that will not allow the end user to over-shoot a satellite. Dish movement rate is synchronized to the signal processing algorithm.

In operation, the operator drives the antenna up or down to the elevation that matches the elevation displayed by the IRD when a local zip code is entered or by a geographic chart. For azimuth, the semi-automatic feature of the present invention allows the operator to simply hold down a left or right arrow control on the remote control console for a few seconds for the autoscan mode to lock-in. The operator then releases the arrow as the satellite dish will continue its automatic rotation at the prescribed elevation throughout the 360° of rotation. The operator watches the television monitor connected to the IRD for satellite reception at which time the operator depresses any arrow key to stop rotation. The arrow keys are then used for fine tuning the satellite dish position to maximize signal strength.

Alternatively, the right or left arrow on the remote control console can be used to directly position the dish. For azimuth, the operator enters the local zip code into the IRD corresponding to compass points. The IRD display shows a satellite location based on degrees. The console display shows a two-digit number showing azimuth position with respect to the vehicle using a clock analogy. For example, the rear center of the vehicle is at 6:00 and the front of the vehicle is at 12:00 and the console displays a two-digit number reflecting dish pointing position relative to the vehicle. If a vehicle compass heading is known, the operator may simply rotate left or right until detecting the signal. Therefore if the end user knows the magnetic direction at which the satellite is located they can rotate the dish to the console azimuth display number that aligns with the magnetic direction. A further embodiment may include a RF sensing board to detect signal strength and automatically stop the rotation of the satellite dish.

The present invention also includes an electronic leveler sensor mounted to the dish under the dome. The electronic leveler sensor rotates with the platform to which the dish antenna is attached. The electronic leveler sensor attached to the dish is also used as a tilt-sensor for determining elevation tilt angle due to the position of the mobile unit. This sensor automatically maintains the elevation of the dish and compensates for any unevenness during all 360° of the azimuth search pattern by providing feedback to bracketed DC motors. This system provides an automatic equalization offset for any unevenness in the ground under the mobile unit which if left uncompensated complicates the satellite search. No end user interface or adjustment is required. The system maintains a constant attitude relative to the horizontal plane as preselected by the up and down arrows on the console The present invention may also include a memory function for satellite locations. An operator simply stores a first known satellite location and then, after locating a second satellite stores that location as well. The operator can then jump between the two locations by using the controller console.

The present invention requires no assembly, no programming and is fully compatible with all IRDs and satellite service providers. It only requires attaching the dome to the host vehicle and then wiring the dome to the console, to the power source and the IRD through a cable sized hole.

DETAILED DESCRIPTION OF THE DRAWINGS

Figure 1:
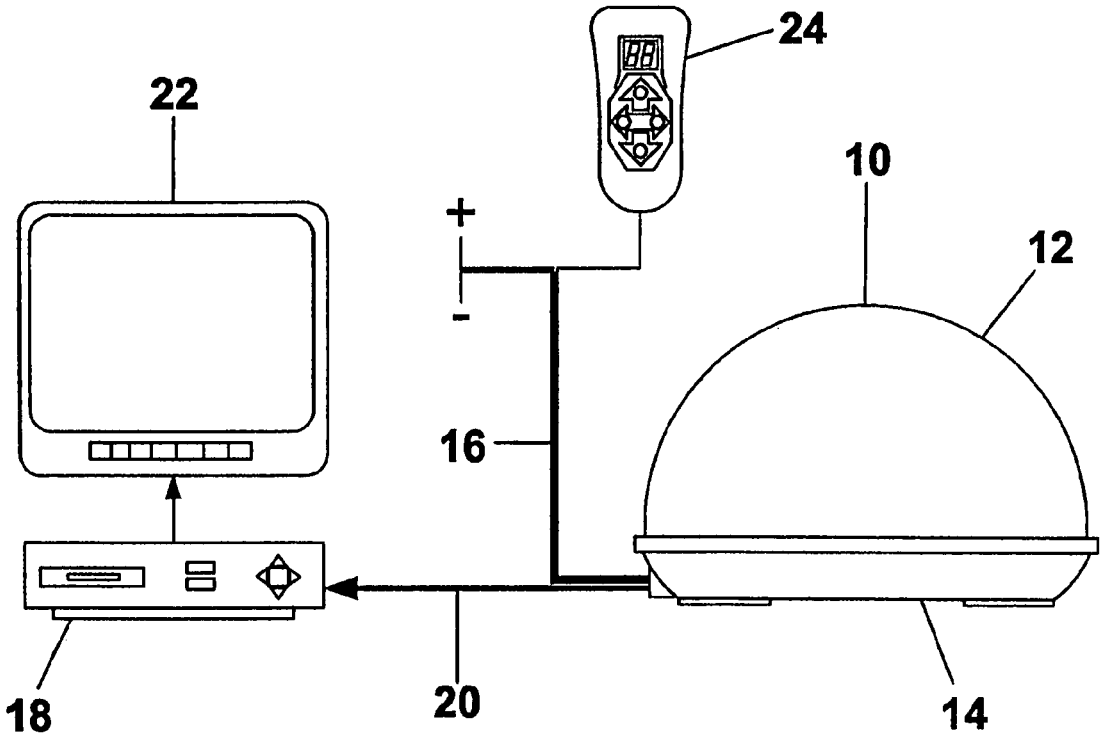
FIG. 1 is a schematic diagram of the components of the present invention

A satellite locator system of the present invention is mounted to a mobile unit for quickly and inexpensively locating a satellite signal. The system includes a parabolic reflector antenna dish, feedhorn, and signal converter mounted on a turntable which supports electronic controls as well as elevation and azimuth motors. A dielectric plastic dome mounted on a base encloses the dish, feedhorn, signal converter, turntable, electronic controls and elevation and azimuth motors. The dome has an inner semi-hemispherical surface located in close proximity, preferably within 2 centimeters, to the signal converter so as to maximize reception and improve signal strength and quickly sheds rain.

While the present invention is not limited in its application to any particular structural design, the satellite locator system as described in U.S. application Ser. No. 10/395,871, filed Mar. 24, 2003, which in turn is a continuation of U.S. application Ser. No. 09/525,790, filed Mar. 15, 2000, (U.S. Pat. No. 6,538,612) entitled, SATELLITE LOCATOR SYSTEM, the entire disclosures of which are considered as being part of the disclosure of the accompanying application and are hereby incorporated by reference.

A remote control console that is wired to the electronic controls operably drives the antenna dish to the proper elevation and azimuth. The dome is a lightweight, ultraviolet light protected, plastic semi-hemispherical cover. The antenna reflector dish is vacuum formed or an injected molded plastic concave paraboloid coated with aluminum or other similar metal having high reflectivity of the desired wavelength. The dish has a parabolic shape with a completely metalized surface having virtually zero ohm resistance across the antenna surface.

Elevation and azimuth control is achieved with a pair of low cost DC electric motors. Preferably, the low cost motors are geared at a high ratio with slippage accommodation designed into the driver (for example, a rubber wheel or drive belt) to protect the gear box. The lack of a change in tilt or rotation due to reaching the physical stop will be sensed by a microprocessor circuit and the appropriate signal will be sent to the control console display and to the motor to shut down.

The present invention further includes an internal electronic leveler sensor that automatically adjusts the tilt angle of the satellite dish for uneven ground conditions. For example, when the host vehicle is parked on the side of an incline, the satellite dish will also be disposed at an incline. Thus the elevation of the satellite dish must be continuously adjusted during rotation in order to maintain a level track at the set elevation. The leveler system is completely integrated with the elevation tilt angle algorithm.

The azimuth position is determined by a potentiometer whose shaft is axially linked to the axis of rotation of the antenna. Rotation of the antenna frame results in varying electric signals developed across the potentiometer to effectuate position sensing.

As illustrated in FIG. 1, the present invention includes a dome unit 10 comprising a dielectric dome 12 and a base 14. Dome unit 10 is electrically connected to a power source inside the host vehicle by wire harness 16. It is envisioned that wire harness 16 will be connected to a 12 Volt power source and to ground. Dome unit 10 is also operably connected to at least one digital integrated receiver/decoder (IRD) unit 18 by coaxial cable 20. IRD 18 is operably connected to a television monitor 22. Additional IRDs may also be connected to dome unit 10. Dome unit 10 is attached to a host vehicle by fasteners extending through a plurality of mounting feet that extend for the bottom surface of base unit 14. Console controller 24, operably connected to the dome unit 10 is used to activate the system, position the dish antenna and access diagnostic information concerning dome unit 10.

Figure 2:
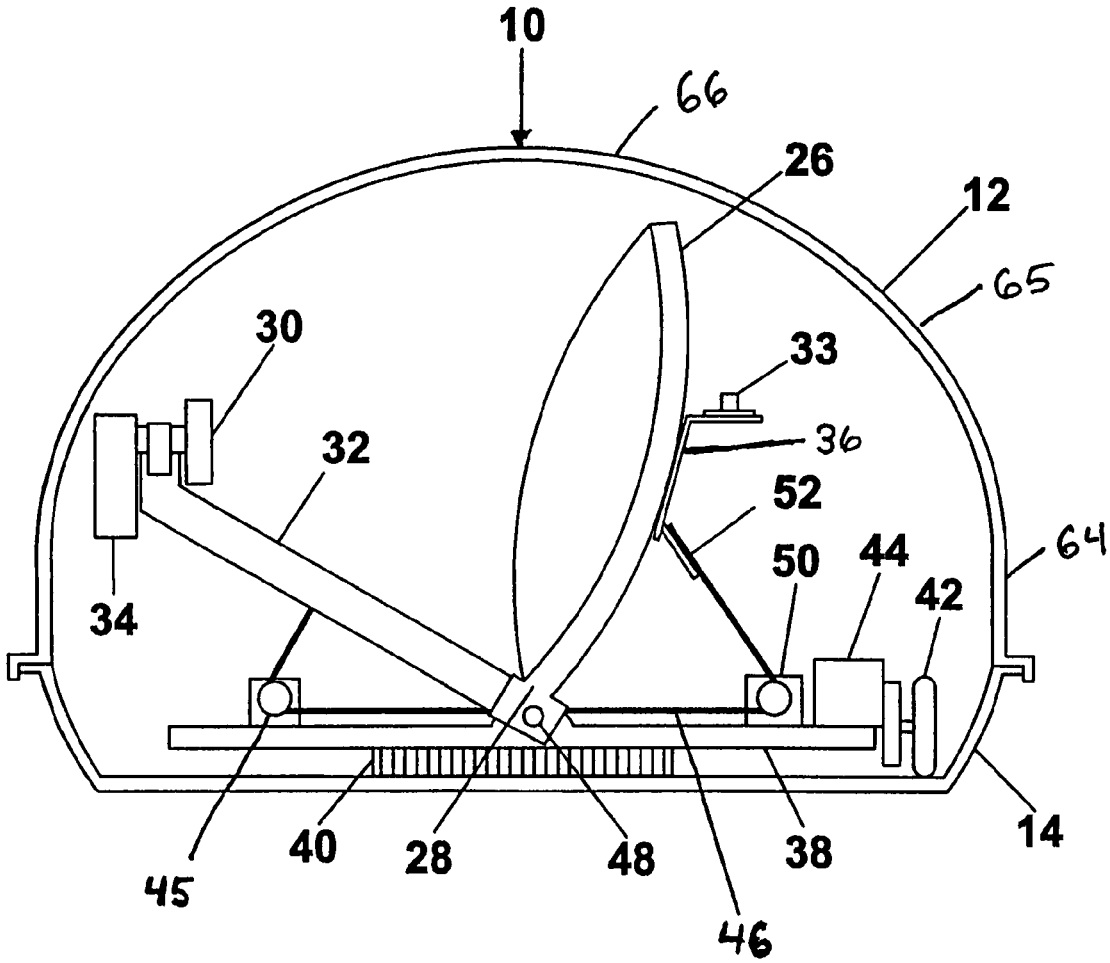
FIG. 2 is a cross sectional view of the dome unit of the present invention.
Figure 3:
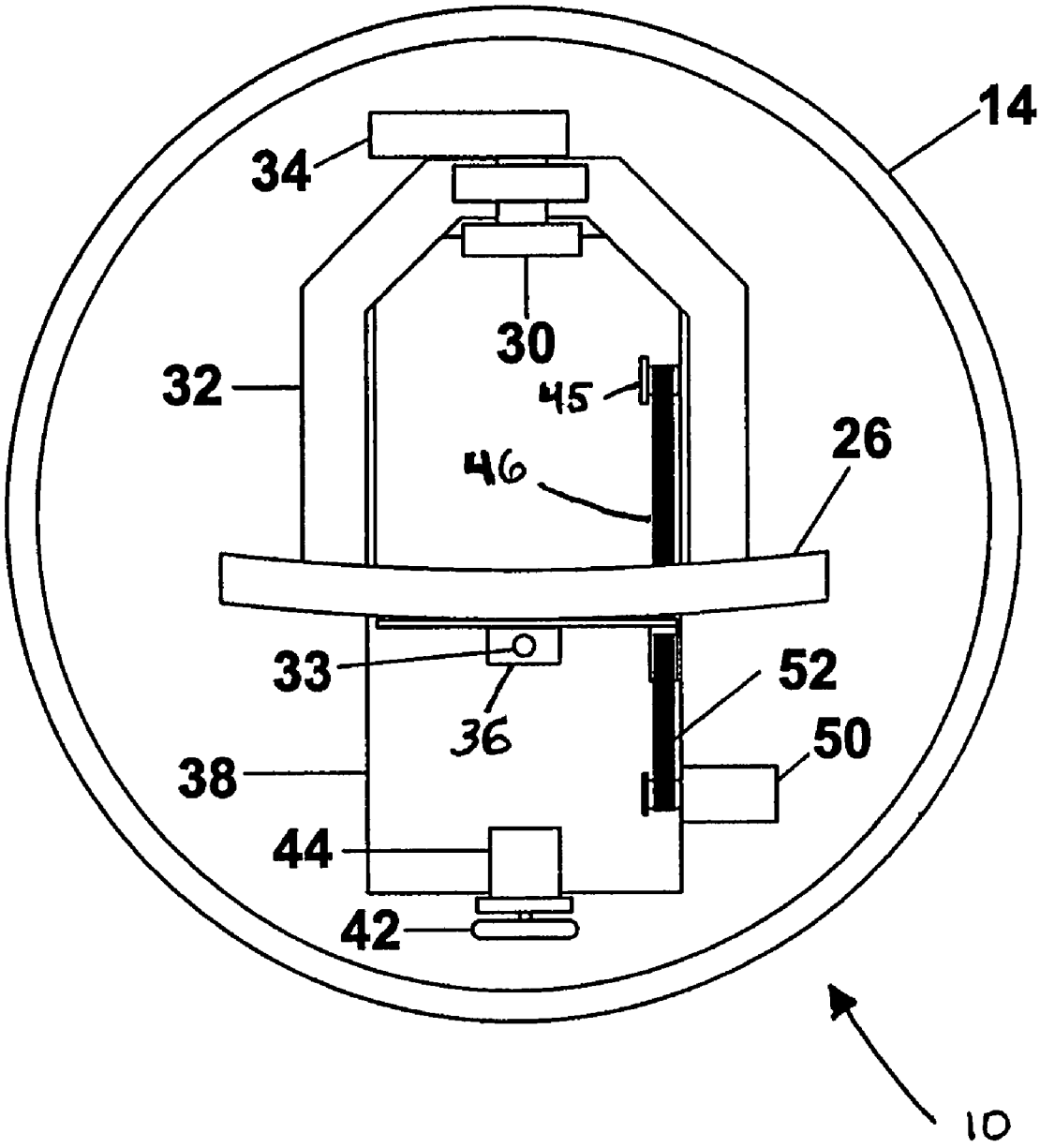
FIG. 3 is a top perspective view of the present invention with the protective dome removed.
Figure 5:
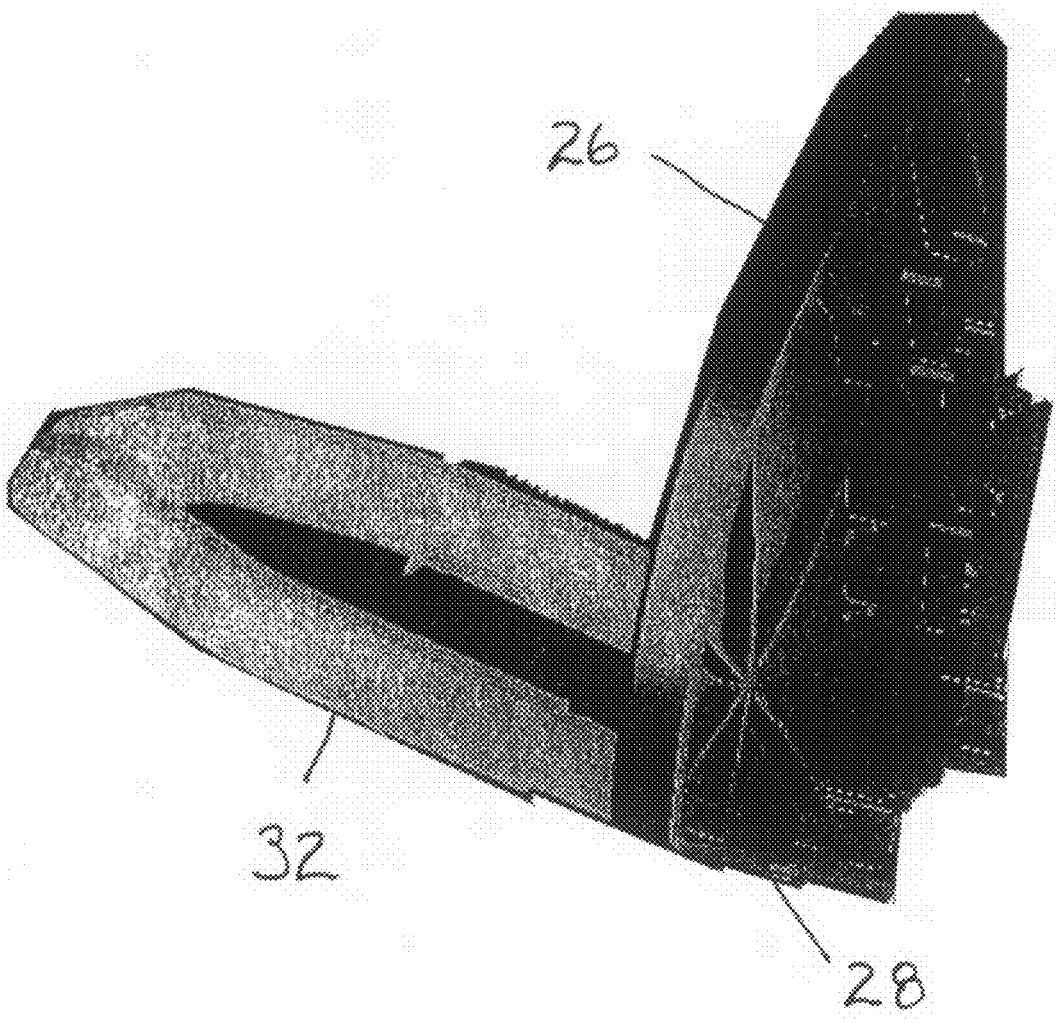
FIG. 5 is a perspective view of the dish antenna with feedhorn support.

As illustrated in FIGS. 2 and 3, dome unit 10 includes dielectric dome 12, a base 14 and a substantially parabolic dish 26. The parabolic dish 26 has a truncated lower edge 28 created by removing a portion of dish 26 so that lower edge 28 is substantially parallel to dome base 14. As a result of removing a lower portion of the parabolic dish 26, dome unit 10 has a lower vertical profile than a parabolic dish of the same diameter. The reduction in dish height reduces the size of the dome 12 which covers parabolic dish 26. As illustrated in FIG. 5, parabolic dish 26 is constructed with a molded rib rear face to add structural support and provide connecting points for other components.

Dome unit 10 further includes a feed horn 30 mounted on feedhorn support 32. Feed horn 32 collects incoming signals at the focus of parabolic dish 26. Feedhorn support 32 is a horseshoe shaped structure, the open end of which supports dish 26. The open ends of feedhorn support 32 are inserted into molded sockets located at the base of dish 26. The electronic leveler sensor 33 is disposed on sensor bracket 36 attached to the molded ribs at the rear face of parabolic dish 26.

Incoming satellite signals are channeled from feedhorn 30 to a low noise block (LnB) converter 34. LnB converter 34 amplifies the signals and converts them from microwaves to low frequency signals transmitted through coaxial cable 20 to IRD 18, as illustrated in FIG. 1. IRD 18 converts signals so they can appear on the screen of television 22.

As illustrated by FIGS. 2 and 3, parabolic dish 26 rests on turntable unit 38 movably connected to bearing mount 40 within dome base 14. Turntable unit 38 rotates by wheel 42 as directed by motor 44. Thus, azimuth or pointing direction of parabolic dish 26 is affected by the frictional interaction of wheel 42 against the interior surface of base 14. It is envisioned that rotation of dish 26 will be limited to two complete revolutions so as not to damage the cables connecting dish 26 to IRD 18. When the potentiometer operably attached to the turntable unit 38 detects no further rotational movement while motor 44 is activated, an electronic command is sent to shut off motor 44. Simultaneously, an electronic signal is sent to display 56 of control console 24.

Elevation of parabolic dish 26 is controlled by a tilt system 46. Parabolic dish 26 is pivotable perpendicular to turntable unit 38 by way of pivot pins 48 mounted to turntable unit 38. Tilt system 46, powered by motor unit 50 advances belt 52 so that parabolic dish 26 tilts to the required elevation about pivot pins 48. Belt 52 is fixed at a first end to arm 32. Belt 52 then extends about forward guide 45 to motor unit 50 and attaches at a second end to sensor bracket 36. Upon reaching the end of travel, the tilt system 46 slips so as to prevent damage to the belt 52 and motor 50. Upon detecting zero change in the electronic leveler sensor 33 while motor 50 is in operation, the dome microprocessor unit simultaneously sends an electronic signal to the console 24 alerting the operator that dish 26 has stopped and turns off motor 50.

Dome 12 is sized to minimize the distance a signal must travel within the dome's internal volume. Dome 12 has three sections; base section 64; parabolic section 65 and top section 66. Base section 64 of dome 12 has a cylindrical shape with substantially vertical walls. Parabolic section 65 intersects base section 64 at the lowest travel elevation of feedhorn support 32. Parabolic section 65 closely follows the arc formed by increasing elevation of feedhorn support 32 until feedhorn support 32 reaches its greatest angle of travel. Top section 66 intersects parabolic section 65 at the point where feedhorn support 32 is at a stop. Top section 66 forms a cap over dome unit 10.

Figure 4:
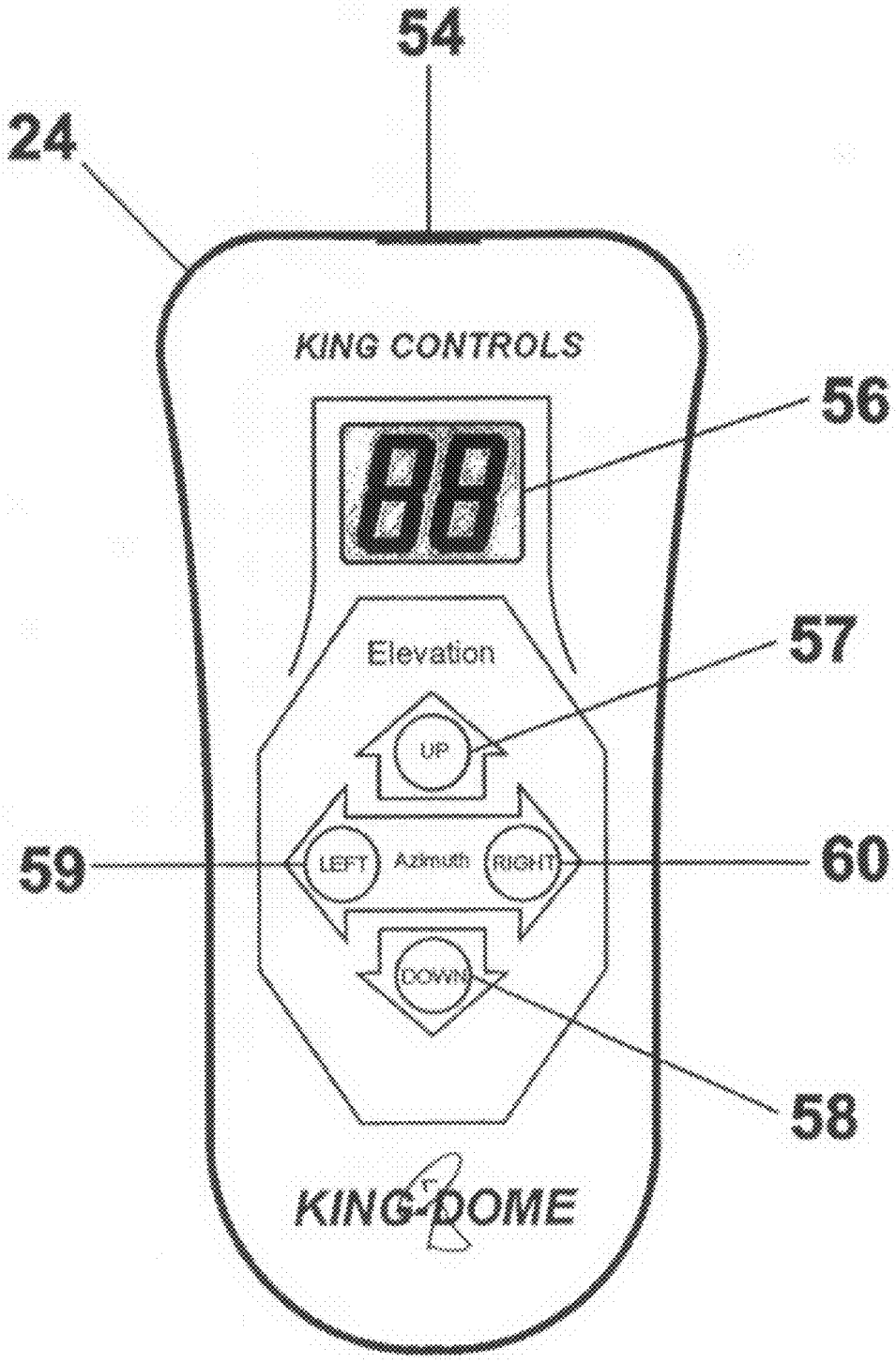
FIG. 4 is a perspective view of the remote console for the present invention.

The control console 24, as illustrated in FIG. 4, is connected by a telephone jack connector 54 to dome unit 10. Control console 24 includes a display screen 56 having two digit readout area. Directly below display screen 56 is up arrow key 57, down arrow key 58, left arrow key 59 and right arrow key 60. Arrow keys 57-60 include a pressure sensitive pad for activating the respective directional control.

In operation, the operator turns on television monitor 22 and IRD 18. A signal meter screen displayed on the television monitor 22 is accessed through the IRD 18. The signal meter screen allows for selection of the appropriate satellite (for example DishNetwork™ or DirecTV™). The operator next enters the local zip code of dome unit 10 into IRD 18 which displays on the television monitor 22 the elevation. If the zip code is unknown, the operator can estimate elevation from elevation maps corresponding to the signal provider.

The dome unit 10 is activated by depressing the up arrow key 57 on the control console 24. Current tilt of parabolic dish 26 is displayed by depressing the up arrow key 57 or down arrow key 58. The up arrow key 57 or down arrow key 58 is depressed so that the tilt of dish 26 matches the appropriate elevation displayed on the television signal meter screen or matched to an elevation chart. Once appropriate tilt is achieved, the operator simply depresses right arrow key 60 and holds it down for a few seconds until the autoscan routine begins. The operator can then release right arrow key 60 as the rotational search will continue until any control key 57-60 is depressed or the dish 26 reaches the end of travel. Parabolic dish 26 will automatically rotate 360° while it scans the sky for a satellite. The operator stops the scan when the signal strength appears on television monitor 22 by depressing any arrow key 57-60. Signal strength is maximized by using arrow keys 57-60 to adjust dish 26.

In addition, control console 24 may be used to store and recall satellite locations. Once an operator has locked onto a desired satellite, the location can be stored by depressing left arrow key 59 and right arrow key 60 simultaneously until the display 56 begins a flashing mode. Next the operator depresses the left arrow 59 until an "OH" appears on display 56.

After a second satellite location is found, the operator repeats the above process of depressing left arrow 59 and right arrow 60 until display 56 flashes. The right arrow 60 is then depressed until an "OH" appears on display 56. To recall the first satellite location the operator depresses left arrow 59 and down arrow 58. To recall second satellite location, the operator depresses right arrow 60 and down arrow 58. The dish 26 automatically returns to the exact azimuth and elevation of the stored satellites.

Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein.

The invention claimed is:

1. A method of providing a satellite dish adapted to be connected to a satellite receiver and a television monitor, the method comprising:

providing a satellite dish including a feedhorn and a signal converter disposed relative to a focal point of the satellite dish the signal converter supplying an output signal for the satellite receiver, the satellite dish further including an elevation drive system and an azimuth drive system operably connected to move the satellite dish, the satellite dish being configured to:

cause the elevation drive system to elevate the satellite dish in response to an elevation command corresponding to a geographic location of the satellite dish;

cause the azimuth drive system to rotate the satellite dish about a vertical axis in response to a directional indication; while automatically leveling the satellite dish;

cause the azimuth drive system to stop rotating the satellite dish upon locating an appropriate signal from a service provider on the receiver monitor based upon an observation of the television monitor as viewed by a user and store a position of the satellite dish as a position of a first known satellite of the service provider;

cause the azimuth drive system to rotate the satellite dish about a vertical axis in response to a directional indication that is provided to the satellite dish;

cause the azimuth drive system to stop rotating the satellite dish upon locating an appropriate signal from the service provider on the receiver monitor based upon an observation of the television monitor as viewed by a user and store a position of the satellite dish as a position of a second known satellite of the service provider; and cause the satellite dish to jump from the second known satellite to the first known satellite based on the position of the first known satellite and the position of the second known satellite in response to a manual input signal provided by a user.

2. The method of claim 1 wherein stopping the satellite dish is further configured to cause the satellite dish to jump from the first known satellite to the second known satellite in response to a second manual input signal provided by a user.

3. The method of claim 1 wherein the satellite dish comprises a covered satellite dish positioned on a vehicle and wherein the satellite dish being configured to cause the elevation drive system to elevate the satellite dish is performed automatically in response to entry of coded information.

4. The method of claim 1 wherein a handheld controller is adapted to communicate with the satellite receiver and wherein the method further comprises:

instructing a user to communicate the coded information, the directional indication, the indication of the appropriate signal based on observation of the television monitor and the manual input signal via the controller.

5. The method of claim 1 wherein the satellite dish being configured to rotate the satellite dish about the vertical axis in response to the directional indication is performed so as to automatically level the satellite dish while the satellite dish rotates about the vertical axis.

6. A satellite dish adapted to be connected to a satellite receiver and a television monitor comprising:

a satellite dish including a feedhorn and a signal converter disposed relative to a focal point of the satellite dish, the signal converter supplying an output signal for the satellite receiver, the satellite dish further including an elevation drive system and an azimuth drive system operably connected to move the satellite dish;

means for causing the elevation drive system to elevate the satellite dish in response to an elevation command corresponding to a geographic location of the satellite dish;

means for causing the azimuth drive system to stop rotating the satellite dish upon locating an appropriate signal from a service provider on the receiver monitor based upon an observation of the television monitor as viewed by a user and store a position of the satellite dish as a position of a first known satellite of the service provider;

means for causing the azimuth drive system to rotate the satellite dish about a vertical axis in response to a directional indication that is provided to the satellite dish while automatically leveling the satellite dish;

means for causing the azimuth device system to stop rotating the satellite dish upon locating an appropriate signal from the service provider on the receiver monitor based upon an observation of the television monitor as viewed by a user and store a position of the satellite dish as a position of a second known satellite of the service provider; and means for causing the satellite dish to jump from the second known satellite to the first known satellite based on the position of the first known satellite and the position of the second known satellite in response to a manual input signal provided by a user.

7. The satellite dish of claim 6 further comprising means for causing the satellite dish to jump from the first known satellite to the second known satellite in response to a second manual input signal provided by a user.

8. The satellite of claim 6 wherein the satellite dish comprises a covered satellite dish positioned on a vehicle and wherein the means for causing the elevation drive system to elevate the satellite dish causes the elevation drive system to automatically elevate the satellite dish in response to entry of coded information.

9. The satellite dish of claim 6 further comprising:

a handheld computer adapted to communicate with at least one of the satellite receiver and the satellite dish; and instructions for the user to communicate the coded information, the directional indication, the indication of the appropriate signal based on observation of the television monitor and the manual input signal via the controller.

* * * * *